United States Patent [19]

McGill et al.

[11] Patent Number: 4,828,933

[45] Date of Patent: May 9, 1989

[54] SCRATCH RESISTANT PLATINUM ARTICLE

[75] Inventors: Ian R. McGill, Thatcham; Kevin A. Lucas, Caterham, both of England

[73] Assignee: Johnson Matthey Public Limited Company, London, England

[21] Appl. No.: 130,497

[22] Filed: Dec. 9, 1987

[30] Foreign Application Priority Data

Dec. 12, 1986 [GB] United Kingdom ..... 8629728

[51] Int. Cl.[4] ..... B22D 27/18

[52] U.S. Cl. ..... 428/610; 428/670; 63/2; 148/430

[58] Field of Search ..... 428/610, 670; 148/430, 148/900, 902; 420/466, 467, 468; 63/2

[56] References Cited

U.S. PATENT DOCUMENTS

| | | | |
|---|---|---|---|
| Re. 31,104 | 12/1982 | Baldi et al. | 252/466 |
| 4,165,983 | 8/1979 | Bourne et al. | 420/468 |

FOREIGN PATENT DOCUMENTS

| | | |
|---|---|---|
| 890260 | 2/1944 | France . |
| 507341 | 6/1939 | United Kingdom . |
| 915089 | 1/1963 | United Kingdom . |
| 2130249 | 5/1984 | United Kingdom . |

OTHER PUBLICATIONS

Japanese Abstracts: vol. 9, No. 112 (C-281); vol. 6, No. 78 (C-102); vol. 4, No. 46 (C-6); vol. 9, No. 153 (C-288); vol. 9, No. 228 (C-303).

*Primary Examiner*—L. Dewayne Rutledge
*Assistant Examiner*—David W. Schumaker
*Attorney, Agent, or Firm*—Cushman, Darby & Cushman

[57] ABSTRACT

A platinum article, especially an article of jewellery, has its surface region modified to improve its scratch resistance by the addition of at least one element which forms an intermetallic compound with platinum, especially aluminum and chromium. The surface region may be formed by the pack cementation chemical vapor deposition process.

7 Claims, 16 Drawing Sheets

| COATING | PACK MIX (WT%) | HEAT TREATMENT | SPECIMENS COATED | | |
|---|---|---|---|---|---|
| | | | Wire | Coupon | Ring |
| Pt - Al | 93 $Al_2O_3$, 5 Al, $2NH_4Cl$ | 730 ± 10°C for 30 mins | ✓ | | ✓ |
| Pt - Zr | 93 $Al_2O_3$, 5 Zr, $2NH_4Cl$ | 730 ± 30°C for 60 mins | ✓ | | |
| Pt - Al/Ti | 88 $Al_2O_3$, 5 Al, 5 Ti, $2NH_4Cl$ | 750 ± 40°C for 60 mins | ✓ | ✓ | |
| Pt - Al/Zr | 89 $Al_2O_3$, 5 Al, 5 Zr, $2NH_4Cl$ | 750 ± 30°C for 40 mins | ✓ | ✓ | |
| Pt - Zr/Cr | 88 $Al_2O_3$, 5 Zr, 5 Cr, $2NH_4Cl$ | 770 ± 20°C for 45 mins | ✓ | ✓ | |
| Pt - Cr/Al/5 Zr | 73 $Al_2O_3$, 10 Cr, 10 Al, 5 Zr, $2NH_4Cl$ | 760 ± 30°C for 50 mins | ✓ | ✓ | |
| Pt - Cr/5 Al/Zr | 73 $Al_2O_3$, 10 Cr, 5 Al, 10 Zr, $2NH_4Cl$ | 745 ± 20°C for 60 mins | ✓ | ✓ | ✓ |
| Pt - 5 Cr/Al/Zr | 73 $Al_2O_3$, 5 Cr, 10 Al, 10 Zr, $2NH_4Cl$ | 740 ± 20°C for 60 mins + half hour furnace cool | ✓ | ✓ | |
| ZGS Pt - Cr/5Al/Zr | 73 $Al_2O_3$, 10 Cr, 5 Al, 10 Zr, $2NH_4Cl$ | - | | ✓ | |
| Pt - Zr/Cr/Ti | 73 $Al_2O_3$, 10 Zr, 5 Ti, 10 Cr, $2NH_4Cl$ | 740 ± 20°C for 60 mins | ✓ | ✓ | |
| Pt - Cr/Al/Zr/Ti | 88.5 $Al_2O_3$, 5 Zr, 2.5 Ti, 2.5 Al, 2.5 Cr, $2NH_4Cl$ | 720 ± 30°C for 50 mins | ✓ | ✓ | ✓ |

FIG 2

FIG 3

| COATING | APPARENT COATING THICKNESS μm | HARDNESS Max Hv | HARDNESS At distance from surface μm | Wt%* COATING |
|---|---|---|---|---|
| Pt - Al | 125-150 | 329 | 75-112 | 2.38 (R) |
| Pt - Zr | 50-125 | 344 | 25 | 5.8 (W) |
| Pt-Al/Ti | 25 | 470 | Surface Reading | - |
| Pt-Al/Zr | 25-30 | 315 | 12.5 | 0.26 (R) |
| Pt-Zr/Cr | 6.5 | 61.9 | Surface Reading | 0.23 (C) |
| Pt-Cr/Al/5Zr | 25 | 552 | 6.5 | 0.26 (R) |
| Pt-Cr/5Al/Zr | 25 | 658 | 13 | 0.53 (R) |
| Pt-5Cr/Al/Zr | 75-100 | 446 | 50 | 1.39 (C) |
| ZGS Pt-Cr/5Al/Zr | - | 450 | Surface Reading | - |
| Pt-Zr/Cr/Ti | 12.5 | 404 | 10 | 0.23 (C) |
| Pt-Cr/Al/Zr/Ti | 10 | 460 | Surface Reading | 0.22 (C) |

* W (wire), R (ring) and C (coupon) refer to the type of platinum specimen from which the wt% coating was calculated. There are greater errors involved with the lighter wire specimens.

(A)
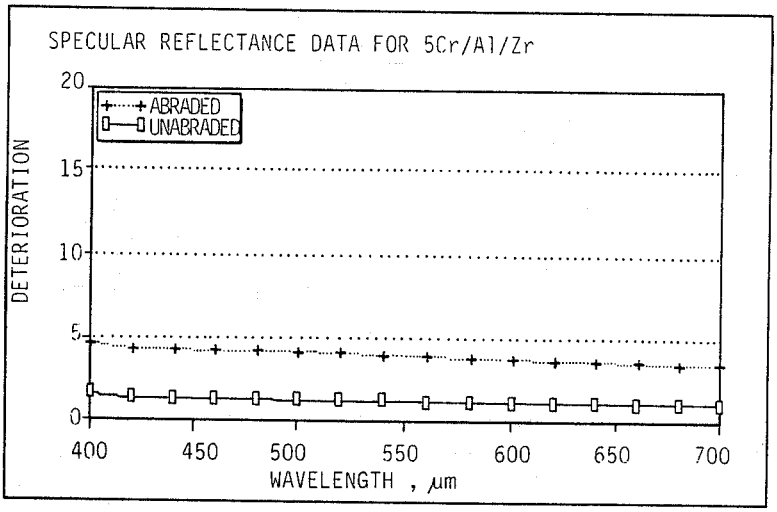
(B)
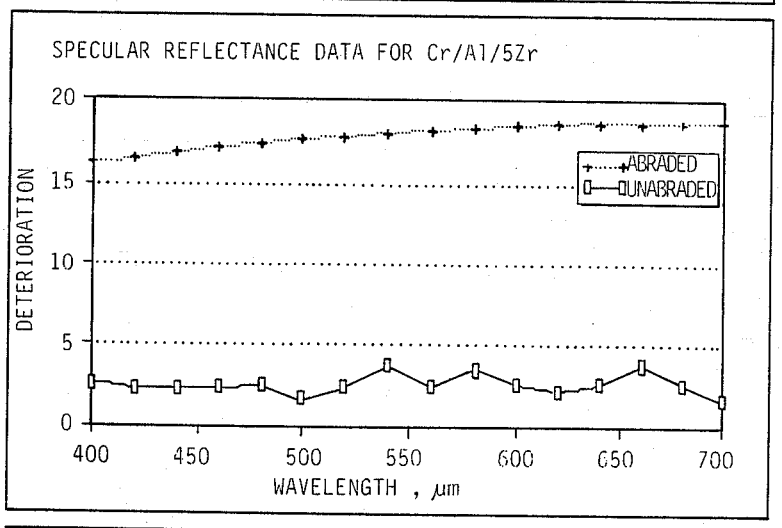
(C)
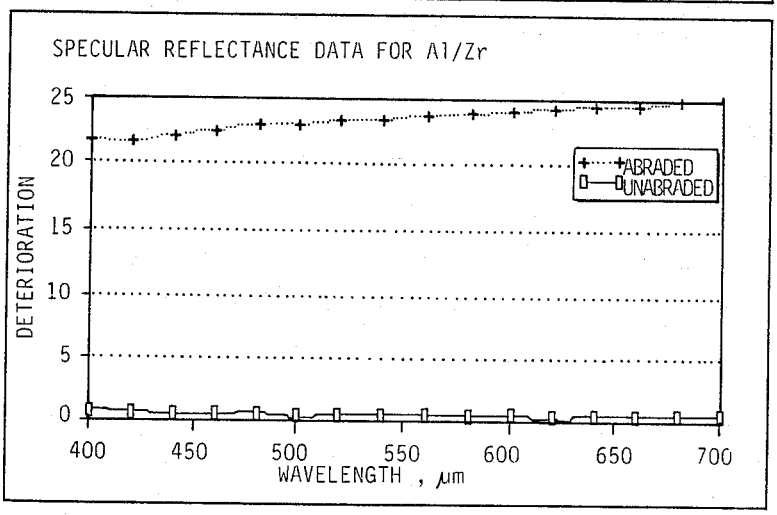
FIG 6

*The curves covered by the bracket are the results prior to abrasion testing.

| Ring No. | Wt.% coating before field trial | Wt% coating after field trial | Surface hardness VPN(*) |
|---|---|---|---|
| 2 | 0.22 | 0.13 | 351 |
| 3 | 0.21 | 0.10 | 537 |
| 4 | 0.37 | 0.18 | 184 |
| 5 | 0.36 | 0.27 | 238 |
| 6 | 0.54 | 0.22 | 359 |

* Substrate hardness = 91 VPN

FIG 10

| Pack Composition (wt.%) | | | | Coating Properties | | |
|---|---|---|---|---|---|---|
| Al | Zr | Cr | $NH_4Cl$ | Colour | Wt.% | Thickness (μm) |
| 2 | - | 10 | 2 | Grey | 1.0 | 30 |
| 1 | - | 10 | 2 | Grey | 0.3 | 10 |
| 1 | 5 | 10 | 2 | Grey | 0.2 | 10 |
| 1 | 2 | 10 | 2 | White | 0.3 | 10 |
| 2 | 2 | 10 | 2 | Grey | 0.4 | 30 |
| NiAl 5wt.% | 2 | 10 | 2 | Whitish | 0.06 | 8 |

FIG 11

SCRATCH RESISTANT PLATINUM ARTICLE

This invention relates to an article having a substrate comprising at least 85% by weight of platinum with a surface region modified to improve its scratch resistance. The invention also relates to a method of forming the surface region and a combination of materials for use in this method. Although the invention can be applied to a wide variety of platinum substrates requiring improved scratch or abrasion resistance, it is particularly suitable for application to platinum jewellery.

Any reference to this specification to platinum substrates or articles shall, unless otherwise specified, be understood as referring to a substrate or article comprising at least 85% by weight of platinum. Scratch resistance is to be understood as resistance not only to scratching but also to other types of abrasion or wear.

Many attempts have been made to improve the scratch resistance of platinum jewellery products. Gloss finished platinum items, in particular, lose their specular reflective properties quickly during service because of incidental abrasion resulting in a depreciation in aesthetic appearance. This is in contrast to the situation with gold or gold-based products which, although not per se scratch resistant, are continually burnished in use, with the result that their reflective properties are not so readily lost as with platinum.

The emphasis placed on platinum jewellery has always been that of good quality and design; however, it is universally recognised that although platinum can retain a high gloss finish during display and prior to sale, it rapidly loses its aesthetic appearance once in service.

Indeed, it is often sought to mask this deficiency in platinum jewellery materials by offering products with designs using a matt surface finish. Any improvement to the wear resistance characteristics of platinum and platinum alloy materials such that a high gloss finish is sustainable would increase the attraction of these materials for jewellery products and may also provide benefits for platinum and platinum alloy products for use in the industrial sector, for example in the glass manufacturing industry. Previous attempts to satisfy this objective have met with little success. For example, platinum alloys have been produced which have hardness values within the range of 60 Hv (Pt-4.5 wt.% Pd) to 450 Hv (Pt-2.5 wt.% Si-2.5 wt.% Au) and this can be increased by cold working; such hard platinum alloys that are within the U.K. Hallmark regulations (at least 95 wt% Pt) would show improvements in abrasion resistance compared with pure platinum but their castability and working characteristics would be of some concern in the manufacture of jewellery products.

There thus remains a need to provide a viable method of enhancing the scratch resistance of platinum, preferably a method which is technologically relatively unsophisticated, to enable jewellery manufacturers and fabricators to use the method as a stage in the manufacturing process without requiring sophisticated equipment or extreme conditions.

According to a first aspect of the invention there is provided an article having a substrate comprising at least 85% by weight of platinum with a surface region modified to improve its scratch resistance by the addition of at least one element selected from those which form intermetallic compounds with platinum.

According to a second aspect of the invention there is provided a method of forming a surface region on a substrate comprising at least 85% by weight of platinum to improve its scratch resistance by incorporating at least one element selected from those which form intermetallic compounds with platinum into the surface of the substrate by means of a pack cementation chemical vapour deposition process.

According to a third aspect of the invention there is provided a combination of materials for use in a method as detailed above comprising an inert carrier, the said at least one element or an alloy thereof, and an inorganic halide activator.

The method of the invention thus provides a relatively simple technique of forming a scratch resistant surface region or coating on a platinum substrate.

For items of jewellery, it may also be desirable for the scratch resistance to be enhanced without significant detriment to its aesthetic appearance, eg. by alteration of colour. This is achieved by at least some of the preferred forms of the invention. Alternatively, it may be desirable to alter the aesthetic appearance by deliberately modifying the colour by means of a substrate surface region according to the invention.

An article according to the invention comprises a surface region containing at least one intermetallic compound of platinum with one or more other metals or metalloids. It is preferred that at least one of the metals or metalloids forming the intermetallic compound comprises aluminium or another element from Group III of the Periodic Table, including the rare earths but excluding the actinides and promethium from Group IIIB, although metals or metalloids from other Groups may be included in addition to or in place of aluminium.

Where aluminium is the intermetallic compound-forming element, the surface region of the article may contain one or more intermetallic compounds such as $PtAl_4$, $Pt_3Al$ and $Pt_2Al_3$. Such compounds may be present in zones within the surface region, interspersed with alloys, solid solutions or other admixture species formed from the intermetallic compound-forming elements and any other elements present, particularly where the surface region is produced by pack cementation chemical vapour deposition.

It is preferred that an article according to the invention is prepared by the pack cementation chemical vapour deposition (CVD) process, which involves the formation and decomposition of active volatile metal halides. During decomposition of the metal halides, selected elements are deposited and diffused into the substrate.

The CVD process is extensively used within the gas turbine industry for the surface treatment of first and second stage turbine blades but a brief description of the process will be given below.

Components to be treated are held within a combination of materials, or powder pack mixture, consisting usually of over 80% inert support medium (eg. alumina), various pore or alloyed elements to form the coating and an inorganic halide activator (usually ammonium chloride, bromide or iodide). A retort containing the powder mixture and components is evacuated and/or purged with inert gas. It is then subjected to heat treatment at the processing temperature during which the retort may be continuously purged with inert gas. Alternatively the retort is sealed under inert gas conditions prior to heat treatment.

On raising the temperature of the pack mixture above the sublimation temperature of the activator (340° C. for $NH_4Cl$, 452° C. for $NH_4Br$ and 551° C. for $NH_4I$), halide vapour permeates through the pack mixture and reacts with the coating elements to form volatile metallic halides. The choice of halide activator is usually determined by a combination of the temperature limit to which the component can be treated and the elements which are required to be diffused into the surface of the component.

In a process where aluminium is the diffusing species, for which the operating temperature is around 800° C., it would not, for instance, be appropriate to use ammonium fluoride as the activator because the metal halide ($AlF_3$) produced by the reaction has a sublimation temperature of 1291° C., whereby $AlF_3$ would be deposited in the pack mixture as a solid.

In this particular case, and in most processes, ammonium chloride would be the most suitable choice of activator as aluminium chloride sublimes at 178° C. producting a reactive vapour species at the processing temperature.

When more than one element is required to be introduced into the substrate surface, a multi-element pack mixture should be used. The chemical halide vapour conditions within the pack are, therefore, more complex and it is not easy to deduce elemental transport mechanisms. However, in broad terms, the active metal halide vapours produced within the pack mixture react with the substrate surface resulting in a dissociation of the metallic halide(s) and deposition/diffusion of the coating element(s).

For example, in the case of co-deposition of chromium and aluminium using a pack activator of ammonium chloride, thermodynamic equilibrium must be established between aluminium chloride and chromium chloride. Whereas at low partial pressures of chromium chloride, chromium deposition is controlled by gaseous diffusion, at high partial pressures, solid state diffusion is more rate determining. The aluminising part of the process is controlled only by gaseous diffusion in the pack.

If aluminium were the sole diffusing species, the coating growth rate would be controlled by solid state diffusion within the substrate, in which case dependency on parameters of the pack mixture (for example particle size) are minimised.

However, in a co-deposition process where gaseous diffusion through the pack is rate controlling, features of the pack mixture such as porosity, amount of activator and the powder particle size, distribution and morphology of the metal constituent and/or the inert support material should be controlled during the coating cycle.

The pack cementation chemical vapour deposition process thus involves not only chemical vapour transport but also solid state diffusion. The constitution and depth of coating on any particular substrate can, therefore, be controlled by adjustment of the composition of the pack, treatment temperature, time at temperature and cooling rate.

In addition to the active elements forming ingredients of the chemical vapour deposition pack, such as aluminium, chromium, titanium and/or zirconium, as well as the activator, modifying elements may be added for particular purposes. Examples of additional elements from various Groups of the Periodic Table include silver (Group IB); magnesium (Group IIA); zinc (Group IIB); boron (Group IIIA); tin (Group IVA) and palladium (Group VIII). In particular, palladium may be used as a hardness control agent and is compatible with the platinum. Other elements which also show significant solid solution characteristics with platinum, for example rhodium, may also be used as modifying agents.

According to further aspects of the invention, the intermetallic compound-forming element is selected from one or more of aluminium, chromium and titanium, preferably aluminium and chromium. Zirconium may also be included although it is thought to be significant in influencing the kinetics within the chemical vapour deposition pack rather than per se forming an intermetallic compound. In contrast, chromium, titanium and, in particular, aluminium diffuse readily into a platinum substrate under pack processing temperature conditions of 700°–1000° C. to form intermetallic compounds in the surface region, although the degree of surface diffusion for any given element is dependent on other elements or species present.

Preferably the thickness of the surface region is in the range 10 to 100 μm as determined by optical microscopy, although electron probe microanalysis may indicate a degree of diffusion to a greater depth, and the hardness of the surface region is at least 200 Hv and more preferably at least 400 Hv. The substrate should preferably comprise at least 95% by weight platinum based on the total weight including the surface region, to enable the invention to be applied to items of platinum jewellery which are to be hallmarked, at least according to the hallmarking standards in the U.K.

In the method according to the invention, a preferred chemical vapour deposition pack comprises calcined alumina as inert carrier, aluminium, zirconium and chromium metallic powders and ammonium chloride activator. The proportions of the metallic powders, as percentages of the overall composition, may include up to 10% of each of aluminium, zirconium and chromium. Exemplary compositions include chromium, aluminium and zirconium in the weight ratios 10:5:10; 5:10:10; 10:2:0; 10:1:0; 10:1:5; 10:1:2; and 10:2:2. Additionally aluminium may be present as nickel aluminide NiAl at a concentration of up to 10%, for example 5% with optionally Zr 2% and Cr 10%.

Chemical vapour deposition conditions may vary in hold temperature, duration of hold temperature and heating and cooling rate. For example, hold temperatures may vary between 700° and 1000° C., preferably 850°–950° C., duration may be up to 8 hours, preferably 3 to 5 hours, and heating and cooling rates may be rapid or slow. In terms of cooling, slow cooling means furnace cooling whereas rapid cooling means air cooling and, in terms of heating, slow heating means placing in a cool furnace and bringing to temperature and rapid heating means placing in a pre-heated furnace.

Properties of the resulting article which may be effected by the choice of processing conditions include surface hardness, colour, thickness of surface region, weight of surface region both before and after polishing, and adhesion and appearance of the surface region. Additionally, particularly for jewellery use in rings, the surface region should withstand substrate deformation such as occurs in "sizing" of rings, without failure or adverse effects on appearance and adhesion.

It has been found that a system which appears to give particularly promising results is based on a pack mixture containing Al 1%, Zr 2% and Cr 10%, with a hold temperature of 900° C. over 4 hours with a slow heating rate and rapid cooling rate.

The invention also includes articles when produced according to the method of the invention and apparatus suitable and intended for putting the method of the invention into effect, for example a furnace programmed to operate to a predetermined heating, hold and/or cooling profile, or a sealable retort having gas inlet and outlet means, and pack cementation charge holder means.

Embodiments of the invention will now be described by way of example with reference to the accompanying Figures, of which FIG. 1 is a cross-sectional view of apparatus for forming a scratch resistant coating on a platinum substrate according to one form of the invention;

FIG. 2 is a Table giving details of the different coatings formed in the tests conducted together with details of the combination of materials and heat treatment used;

FIG. 3 is a Table giving details of the thickness and hardness of the coatings mentioned in FIG. 2;

FIGS. 6A, 6B and 6C are graphs showing the specular reflectivity at different wavelengths for three of the coatings formed before and after abrasion;

FIG. 10 shows in tabular form some details of field trials on various specimens; and FIG. 11 shows in tabular form some coating properties resulting from various pack compositions.

In the Figures, any reference to "coating" or "coated" indicates a surface region or the specimen having been treated to provide a surface region, respectively.

In order to evaluate the chemical vapour deposition process for producing scratch-resistant surface regions on platinum, the following procedure may be applied. A series of 100 g combinations of materials, or pack mixes, are prepared from combinations of aluminium, zirconium, chromium and titanium as the active elements, ammonium chloride as the activator and alumina as the inert filler. The exact pack compositions used are given in the Table in FIG. 2.

Figure 1:
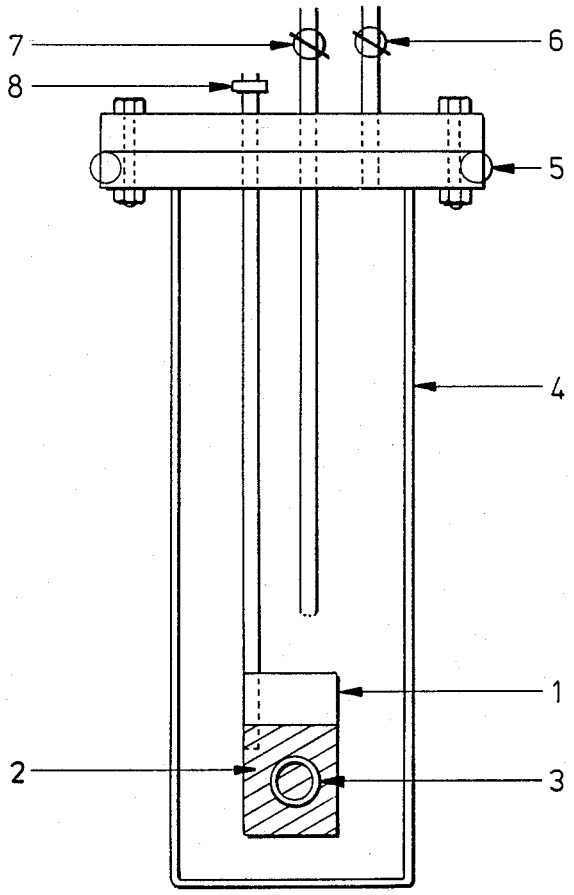

A diagram of the processing retort is given in FIG. 1. A stainless steel pot 1 was filled with a 100 g pack charge 2. Platinum specimens 3 (wires, coupons or rings) were weighed and embedded in the pack 2. The pot 1 was placed inside a flanged Inconel retort 4 equipped with a lid and a water-cooled O ring seal 5 between the flanges. The retort was evacuated to at least $8\times10^{-2}$ Torr via line 6 and backfilled with argon to above atmospheric pressure via line 7. The retort 4 was re-evacuated to approximately $1.5\times10^{-1}$ Torr and then sealed. The retort 4 was heated to the temperature indicated in FIG. 2 as indicated by a thermocouple contained in sleeve 8 and held there for the required time, and then cooled rapidly. The treated specimens 3 were removed from the retort 4, cleaned and weighed. The wires and coupons were mounted and polished. The rings were simply polished.

As will be discussed further below, this treatment modifies the surface region of the platinum substrate by the addition of elements such as Al, Zr and Ti. These elements form intermetallic compounds with platinum in the surface region. The intermetallic compounds of platinum are known to be harder than platinum itself and it is believed that their presence assists in enhancing the scratch resistance of the platinum substrate. The intermetallic compounds are also brittle and can often show some colouration. However, by modifying the concentration and/or activity of diffusing species, these deleterious properties of intermetallics can be minimised or, alternatively and in the case of colouration, deliberately developed.

A list of elements which form intermetallic compounds with platinum can be found in the Metals Reference Book edited by Colin J. Smithells, 5th Edition published by Butterworths in 1978, the contents of which are herein incorporated by reference.

Hardness tests were carried out on the coated specimens as follows:

(a) Wires—hardness profiles were obtained through the thickness of the surface region into the platinum substrate using a Leitz Miniload microhardness instrument.

(b) Coupons—the hardness was determined using a Leitz Miniload microhardness instrument to ensure that the surface region had not been removed after polishing.

(c) Rings—the hardness was determined using a Vickers hardness indentor.

Abrasion tests were also conducted. Treated coupons were mechanically abraded by stroking with an abrasive pad, eg. a Scotchbrite (Trade Mark) pad, loaded with 200 g over the specimen surface 2000 times. The test was periodically interrupted to measure the degree of surface deterioration. As a comparison the same test was performed on pure platinum but the number of abrasion strokes was reduced to 100. Above 100 strokes, there was negligible further increase in the surface degradation of the pure platinum.

Figure 5:
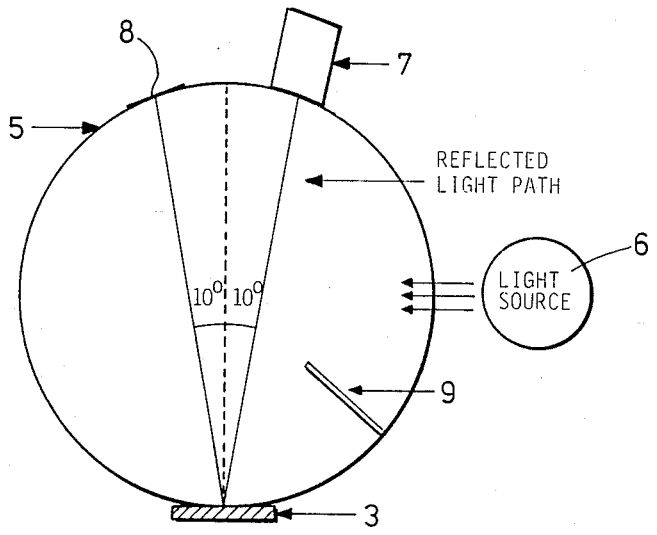
FIG. 5 is a schematic diagram of apparatus used to quantify the specular reflectivity of the coatings.

The surface of the treated coupon was characterised before and during the abrasion test using a Micromatch (Trade Mark) apparatus based on a specular reflectance technique to determine the degree of surface roughness which corresponds to the degree of scratching. A diagrammatic representation of the apparatus used in this technique is shown in FIG. 5. There are two modes of operation of the apparatus: (1) with the specular component included and (2) with the specular component excluded (the specular component is defined as the reflected incident light beam, in this case at 10° to the normal). A gloss surface (smooth) should normally be tested with the specular component included and a matt surface (rough due to particle additions) with the specular component excluded.

The apparatus comprises a hollow sphere 5 which is white on the inside. There are four ports in the sphere 5 to accommodate a light source 6, a reflectance detector 7, the specimen 3 and the fourth to enable the specular component to be removed. To achieve this a white tile 8 is replaced by a black tile to absorb the incident light to prevent a specular component being generated. A baffle 9 is also provided to prevent light from the light source 6 falling on the specimen 3 directly.

For a smooth surface most of the reflectance spectrum is generated by the specular component so greater sensitivity is obtained by including the specular component. For a rough surface, the significance of the specular component decreases as the surface becomes rougher. In this case the specular excluded mode is more sensitive. The wavelength of the incident light is approximately 0.5 microns. For this reason the specular excluded mode is more suitable for determining the degree of surface roughness.

The hardness of the surface regions, the thicknesses and the weight % of the diffusing species for the components used are given in the Table in FIG. 3. It will be seen that the maximum hardness for most of the specimens tested is at least 300 Hv and, for the Al-Zr-Cr systems, at least 400 Hv. A wide range of surface region thicknesses can be used but, in general, it is thought that a minimum of 10 μm is required to ensure adequate coverage of the substrate and a maximum of 100 μm to avoid reducing the overall platinum content below a given value, for example 95% by weight. Hardness profiles for two of the components together with that for untreated platinum are given in FIG. 4.

Figure 4:
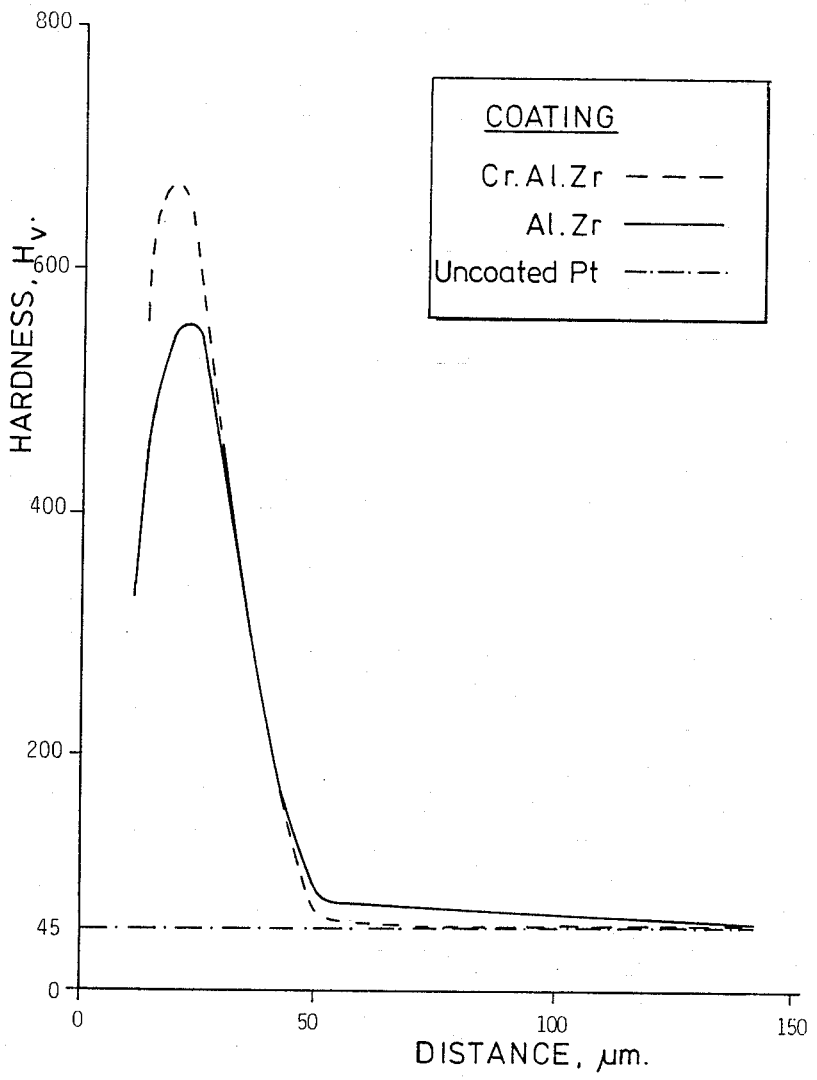
FIG. 4 is a graph showing hardness v. depth for two of the coatings formed compared with uncoated platinum.

The treated wires and rings show that significant surface hardening can be achieved by this process. The hardness of the surface region is up to 10–15 times that of the platinum substrate up to a depth of 20 μm. Cr-5Al-Zr was the hardest of the systems investigated at approximately 658 Hv. It should be noted that the hardness readings serve only as an indication since the indentation made in the test may span several different metallic phases in the surface region. The localised hardness may thus exceed that recorded. The profiles in FIG. 4 show how the hardness increases and reaches a peak at approximately 20 μm from the surface. It is thought that this may correspond to the presence of a particular intermetallic phase.

Figure 7:
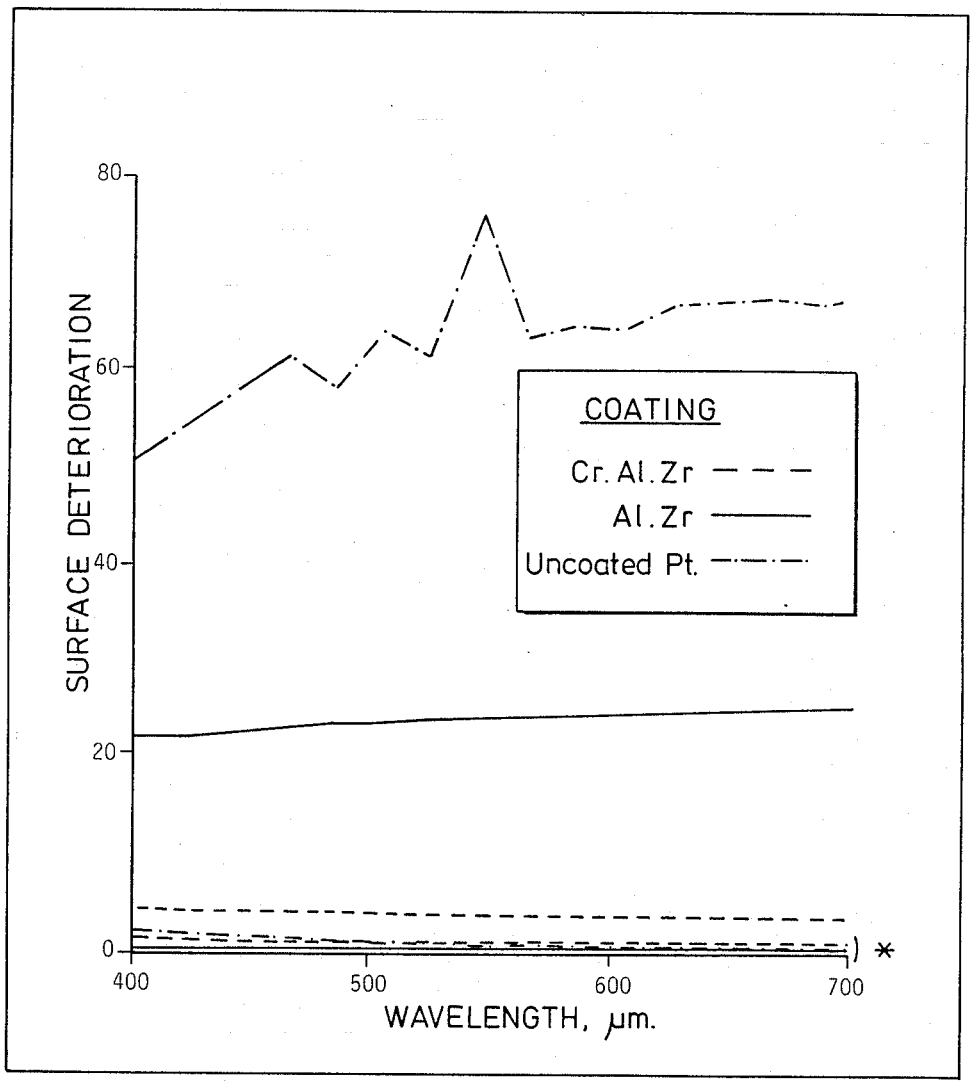
FIG. 7 is a graph showing the specular reflectivity for the best and worst coatings tested compared to uncoated platinum.
Figure 8A:
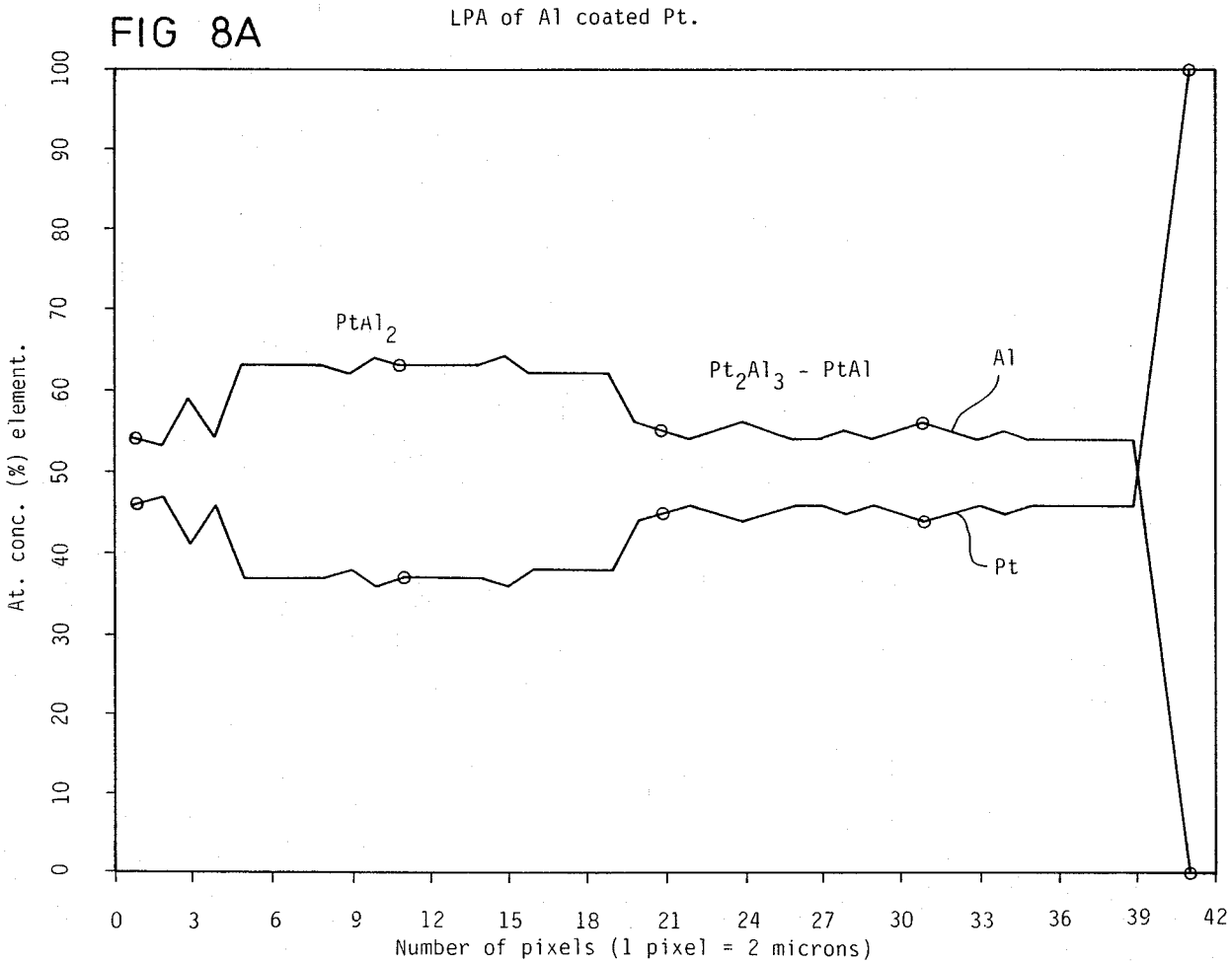
FIGS. 8A to 8F are schematic elemental traces for some of the coatings tested.
Figure 8B:
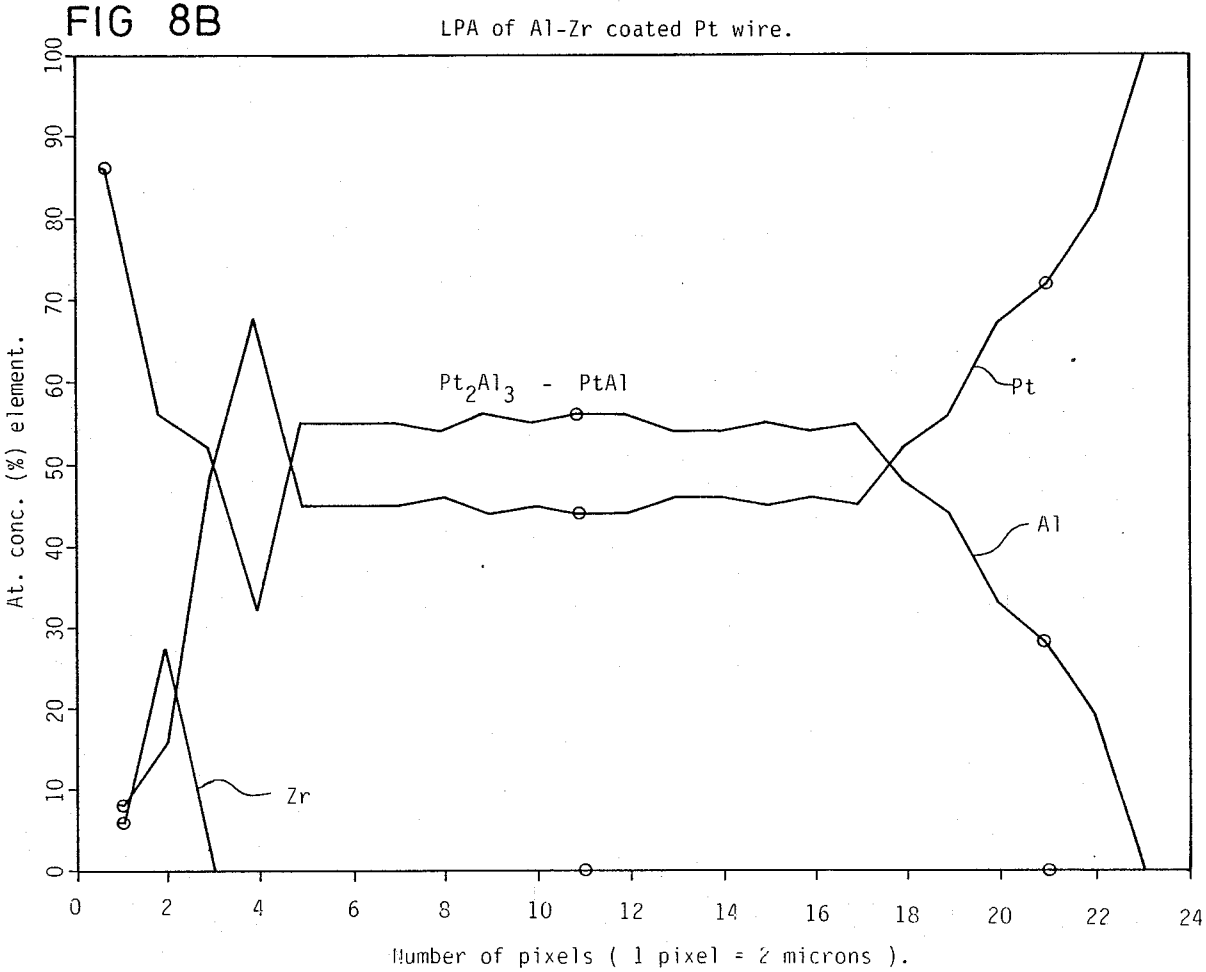
Figure 8C:
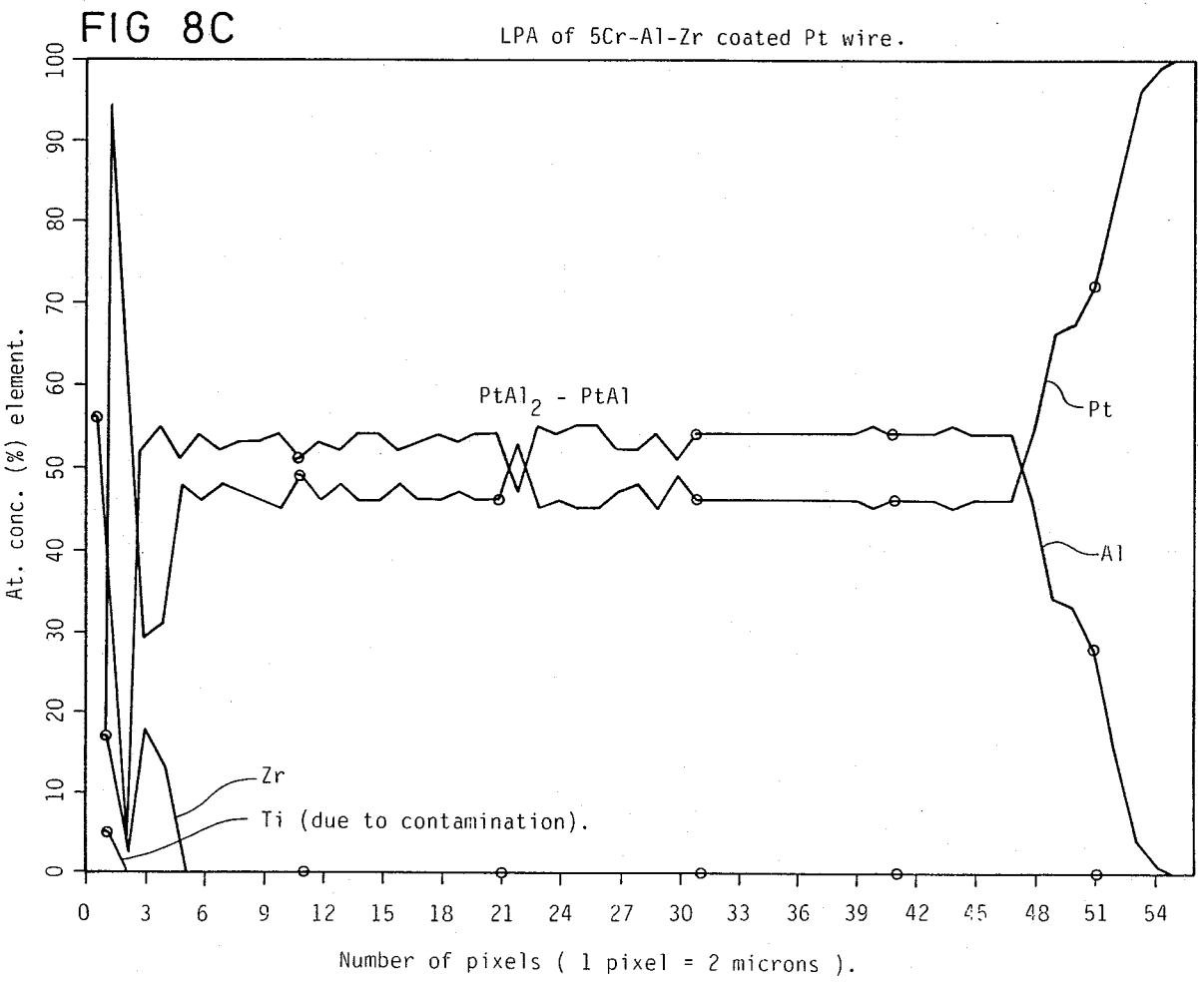
Figure 8D:
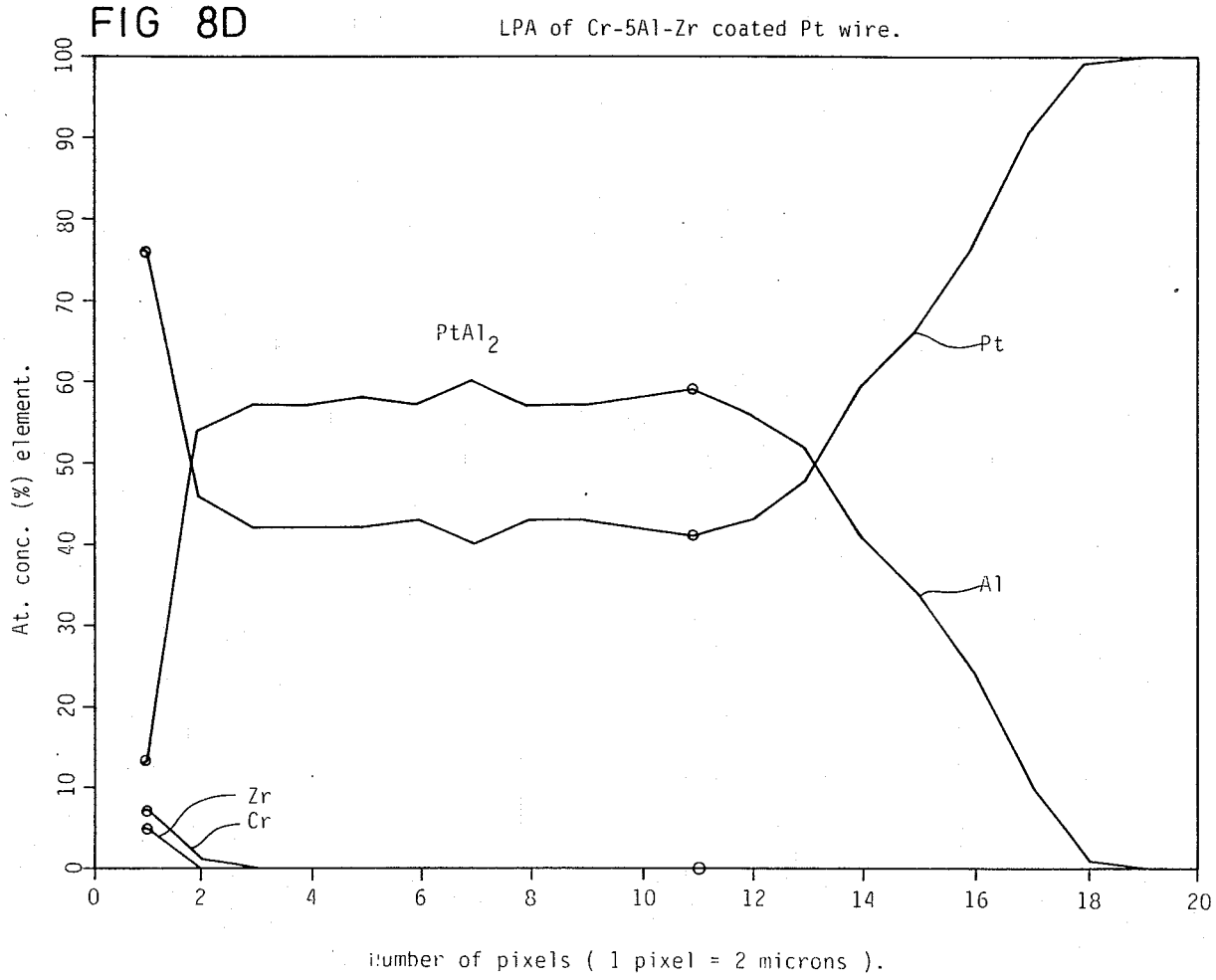
Figure 8E:
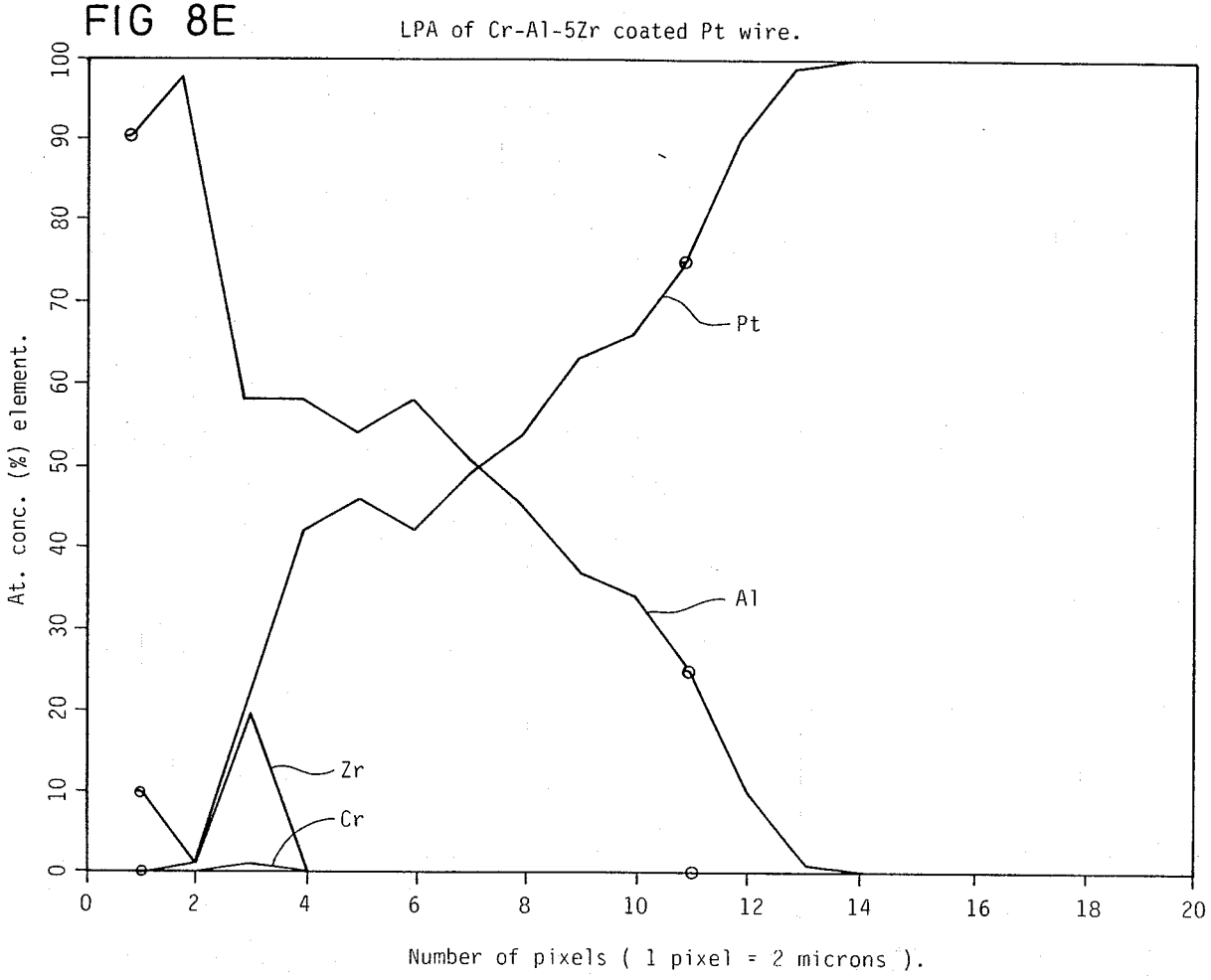
Figure 8F:
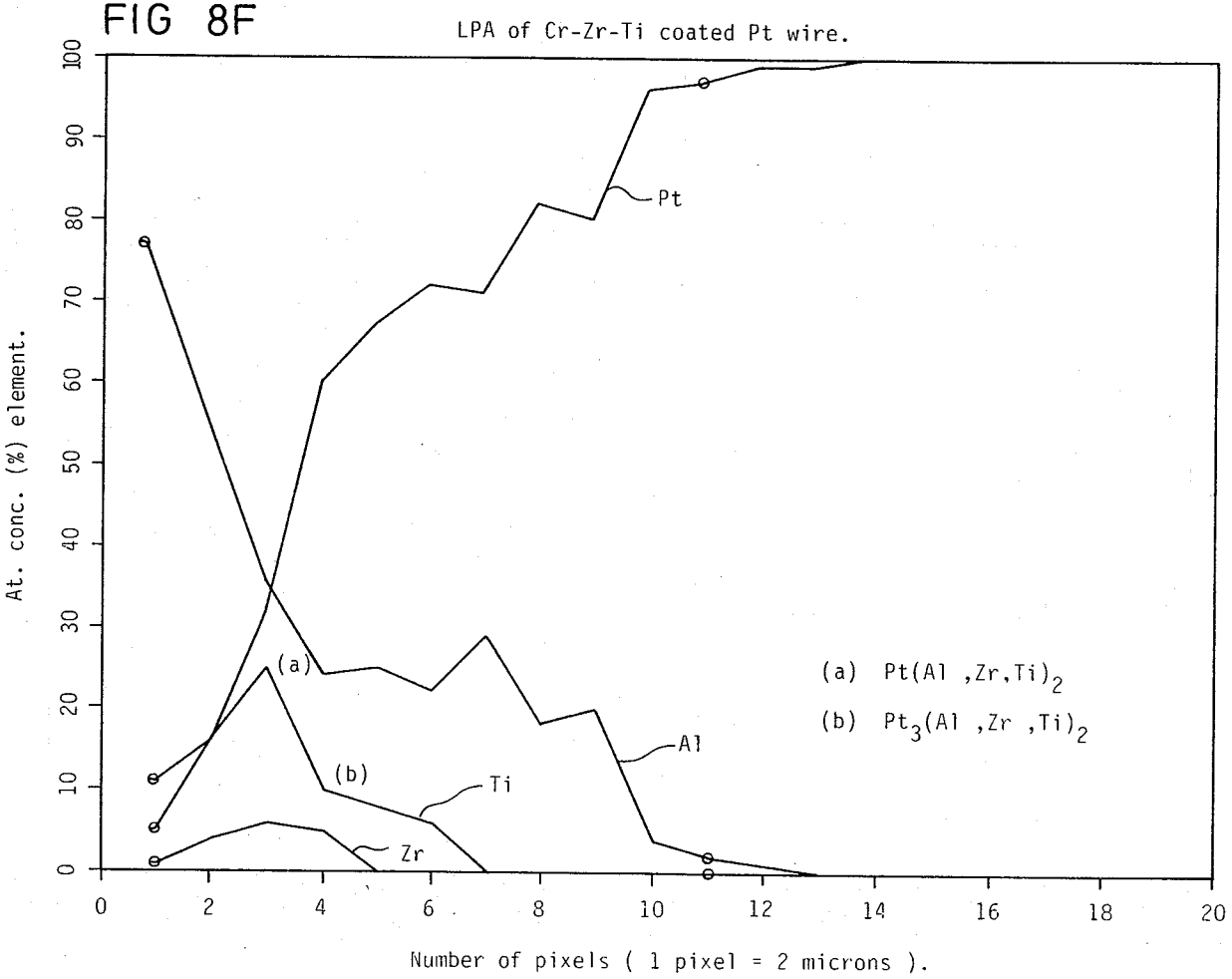

Specular reflectance curves for three of the treated specimens before and after abrasion tests are shown in FIGS. 6A, 6B and 6C. The ordinate axis of the graphs is an indication of the surface roughness. The Micromatch specular reflectance technique detects only that light which is scattered in the 'Specular Component excluded' mode. The amount of scattered light is dependent upon the roughness of the surface. As the roughness increases so the detection signal increases. The curves indicate that the surface deteriorates after abrasion testing. FIG. 7 shows how the wear resistance of the best and worst specimens tested compare to untreated platinum. The wear resistance of all the treated specimens tested was superior to that of untreated platinum.

Care must be taken when comparing specular reflectance information from different tests. The surface regions are of different thicknesses and, more importantly, of different surface conditions prior to testing. The specular reflectance results should therefore not be taken as quantitative. However, the tests show that the Cr-Al-Zr system shows good scratch resistance. Further tests were therefore carried out on this system.

Three Cr-Al-Zr pack mixed were used in which the concentrations of species available for diffusion into the platinum substrate were varied. Details of the mixes used are given in the Table in FIG. 2.

The Cr-Al-5Zr system was rejected because of its poor wear resistance despite exhibiting high hardness. Both the Cr-5Al-Zr and 5Cr-Al-Zr systems show good wear resistance although they appear slightly more yellow than platinum. This is thought to be due to the presence of a modified $PtAl_2$ intermetallic compound being generated at the surface. Oxide grain stabilized/-strengthened platinum, for example zirconia grain stabilized platinum as commercially available from Johnson Matthey PLC under the trade mark "ZGS" platinum was also treated with Cr-5Al-Zr and this produced a hard surface region (approximately 450 Hv). However, this specimen exhibited poor wear resistance.

All the treated platinum wires listed in FIG. 2 were subjected to an elemental analysis by electron probe microanalysis to determine the atomic percentage of the diffused species through the thickness of the surface region. Schematic elemental traces of some of the specimens tested are shown in FIGS. 8A to 8F.

From the elemental profiles, it is apparent that the composition at any point through the surface region usually lies between the composition of two intermetallic compounds. This would imply that the observed layers in the surface regions are not individual intermetallic compounds but mixtures of intermetallic phases.

The elemental traces show that, at the treatment temperatures involved in the present work (700°–1000° C.), aluminium diffuses most readily into the platinum substrate at a depth of up to 120 μm. The other elements affect the diffusion of aluminium into the platinum substrate in two ways.

1. The Pt-Al intermetallic compounds are modified by the presence of the other elements, and
2. The transport of aluminium to the substrate is hindered by the formation of halides of the other species present.

The aluminium profiles can be tentatively matched up with the observed intermetallic layers for several of the systems as indicated in FIGS. 8A to 8F.

The zirconium penetration was fairly consistent through the range tested having an effect over approximately 10 μm in all specimens processed in Zr-containing packs except where Zr was the only diffusing species present; in this case the Zr penetrated to a depth of 38 μm.

The Zr-Cr-Ti trace (FIG. 8F) shows the titanium content to be 11 at % (at the surface). The penetration depth for Ti in this coating is 8 μm.

The elemental traces show chromium to be present in very small quantities for the Cr-Zr and Cr-Al-Zr (FIGS. 8C to 8D) systems. In fact, the Cr count for the 5Cr-Al-Zr (FIG. 8C) system was so low that it could not be distinguished from background counts. The presence of Cr within the intermetallic compounds formed within the surface region of the substrate for this particular pack composition and processing conditions is believed to have a minor effect on the properties of the treated surface region. Instead Cr is thought to have a larger role in influencing the reaction kinetics within the pack itself.

There are instances where it appears that elements may be substituted, from example the Cr-Ti-Zr system (FIG. 8F) displays both $Pt(Al/Ti/Zr)_2$ equivalent to $PtAl_2$ and $Pt_3(Al/Ti/Zr)_2$ equivalent to $Pt_3Al_2$.

The above tests were carried out on platinum substrates which comprise 95.5% by weight of Pt and 4.5% by weight of Cu. However, it is to be expected that similar results would be achieved with other high platinum content substrates, for example comprising at least 85% by weight of platinum, as commonly used in the platinum jewellery business. It will be appreciated that to satisfy the U.K. Platinum hallmarking requirements, the overall platinum content of an article, including the surface region formed as described above, should be at least 95% by weight.

It will also be appreciated that for aesthetic reasons, it may be desirable for the treated article to have a colour as similar as possible to that of untreated platinum. The colours of the surface regions described above varied but, in general, they were substantially the same colour as the untreated substrate. In particular it is noted that the slightly yellow colour produced in some specimens and which is thought to be caused by the presence of $PtAl_2$ is reduced by the inclusion of Zr in the surface region. Equally, it is possible to produce coloured specimens should this be required. In this respect, intermetallic compounds of platinum and palladium have colours or colourations as follows:

| | |
|---|---|
| $PtAl_4$ | white |
| $PtAl_3$ | ivory |
| $PtAl_2$ | yellow |
| $Pt_2Al_3$ | blue-grey |
| PtAl | pink |
| $Pt_3Al$ | white |
| Pd—In | bright yellow to lilac, depending on composition |
| Pt/Pd—Li/Mg and/or Sn/Sb | brass yellow, copper-red or red-violet depending on composition. |

Figure 9A:
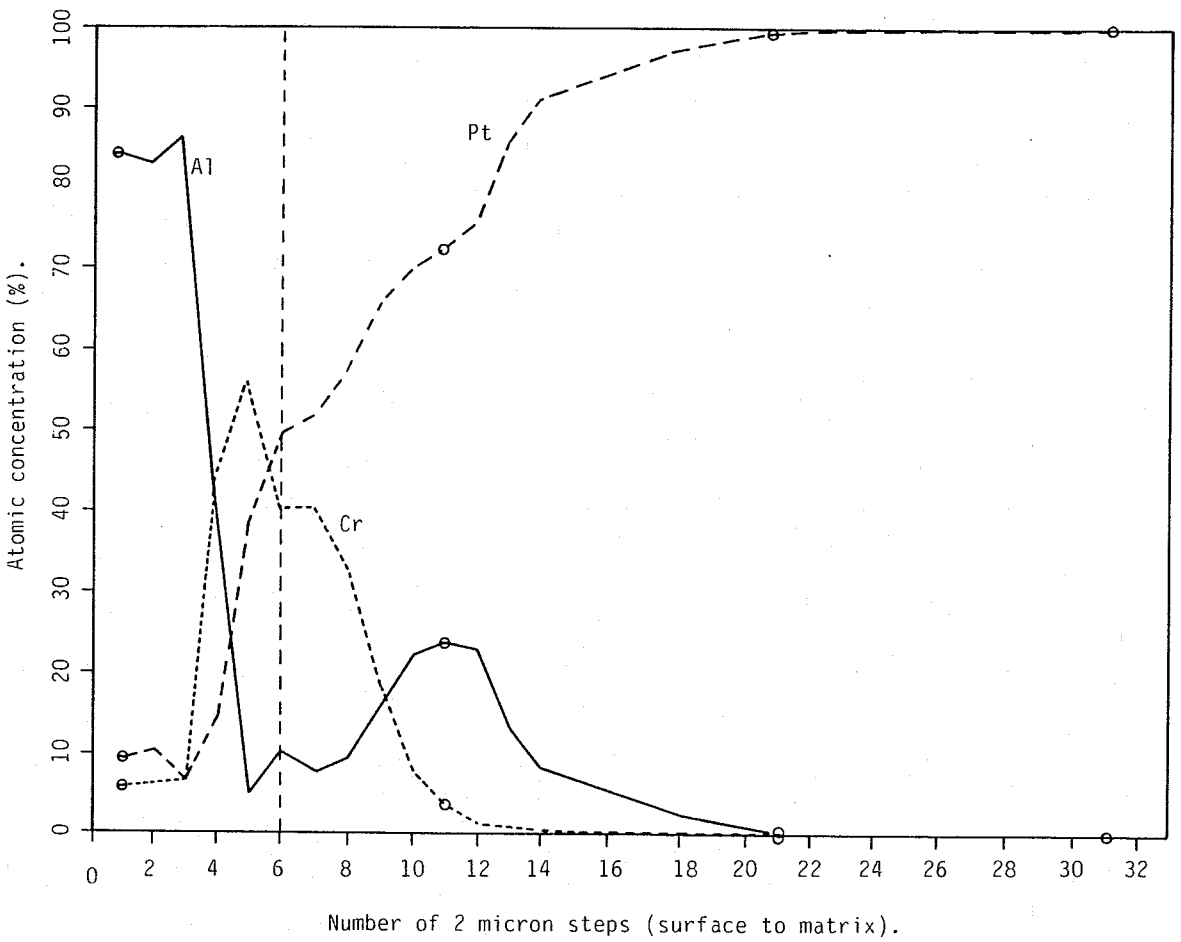
FIGS. 9A–9B are schematic elemental traces of a preferred coating.
Figure 9B:
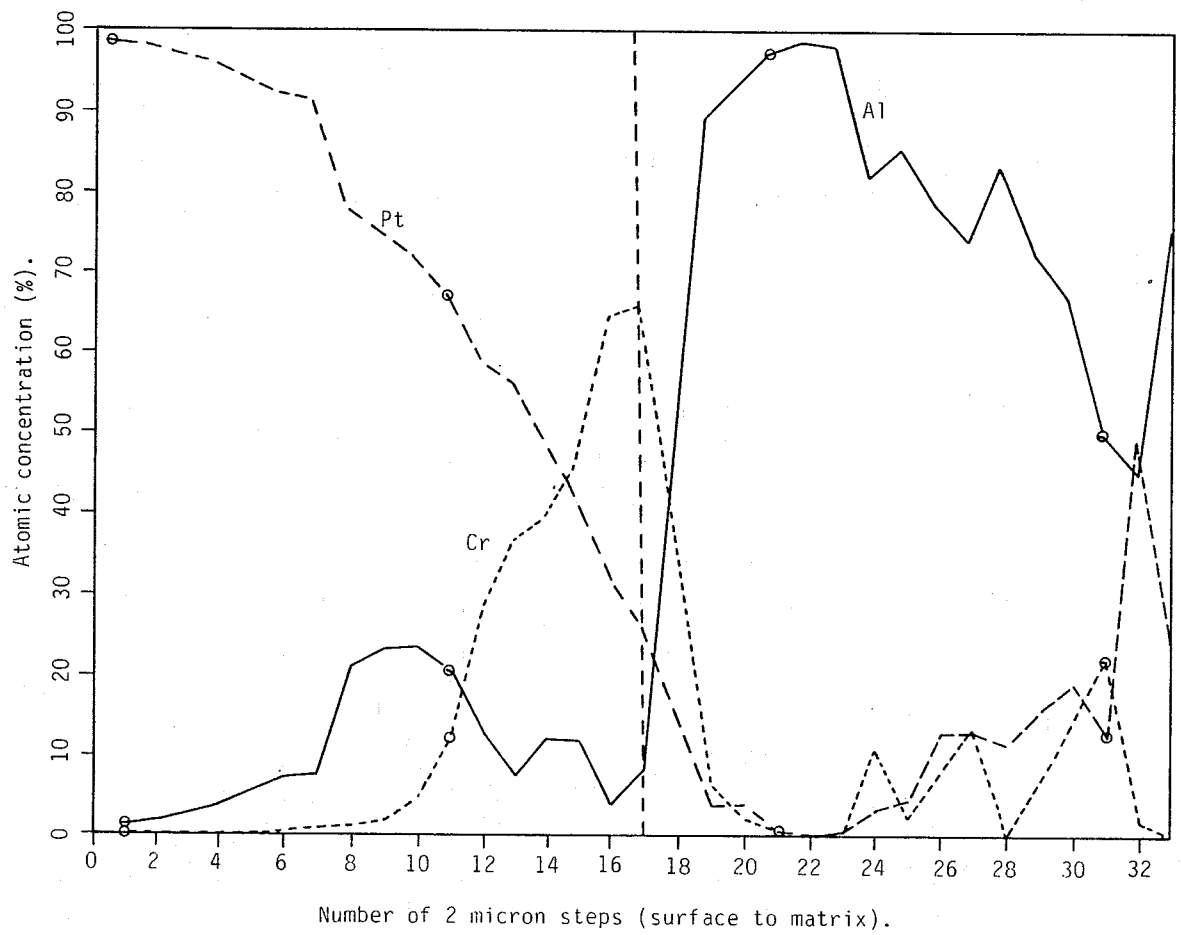

FIGS. 9A and 9B show results for the preferred treatment pack of Al:Zr:Cr at 1:2:10 held at 900° C. for 4 hours with a slow heating rate and a rapid cooling rate. FIG. 9A charts the elemental traces from the surface, after polishing, towards the substrate whereas FIG. 9B shows the equivalent trace from the substrate to the surface, the surface not having been polished. Polishing is seen to remove approximately 20 μm of material, the residual surface being very high in aluminium (>85 at. %). This approximates to the white intermetallic compound $PtAl_4$.

Within 10 μm, aluminium has fallen to c. 5 at. %, chromium and platinum being the main constituents, at approximately 45 at.% each. Chromium decreases to zero at approximately 30 μm, whereas aluminium shows a small peak of 25 at.% at c. 24 μm; this correlates with the compound $Pt_3$ Al, also white.

In contrast, the specimens represented in FIG. 8 contained $PtAl_2$ and were relatively steel-grey in colour, although the compound itself is per se yellow.

In the field trials, five treated and five untreated rings were worn for a period of one month with their progress being monitored at regular intervals. FIG. 10 details thickness and hardness of the surface regions and also shows the effect of processing temperatures and ring surface area on the surface region weight %. (Rings 2 and 3 were held at 765° C. for 1 hour; 4, 5 and 6 at 800° for 1 hour; ring 6 had a surface area of approximately ⅔ that of rings 2, 3, 4 and 5).

The treated rings retained a much higher degree of their initial lustre than the uncoated rings.

FIG. 11 shows the effect on surface region properties of varying the pack composition. The composition Al 1%:Zr 2%: Cr 10% was selected as preferred overall; it also gave excellent results on surface appearance and adhesion.

We claim:

1. An article having a substrate comprising at least 85% by weight of platinum, wherein the article is provided with a surface region modified to improve its scratch resistance by the addition of at least one element selected from those which form intermetallic compounds with platinum.

2. An article according to claim 1, wherein the surface region contains at least one intermetallic compound of platinum with one or more other metals or metalloids as the intermetallic compound-forming element.

3. An article according to claim 1 or claim 2, wherein at least one of the intermetallic compound-forming elements comprises aluminium or other Group III element.

4. An article according to claim 2, wherein the surface region contains the said intermetallic compound or compounds disposed in zones interspersed with alloys, solid solutions or other admixture species.

5. An article according to claim 1, wherein the surface region includes aluminium, zirconium and chromium, the aluminium and chromium being intermetallic compound-forming elements with platinum.

6. An article according to claim 5, wherein the thickness of the surface region is in the range of 10 to 100 μm.

7. An article according to claim 6, wherein the surface region has a hardness of at least 200 Hv.

* * * * *